US010627149B2

(12) United States Patent
Pitsinki et al.

(10) Patent No.: US 10,627,149 B2
(45) Date of Patent: Apr. 21, 2020

(54) APPARATUS COMPRISING SEALED CONTAINER FOR DRY ICE AND TRANSPORT CONTAINER STRUCTURE

(71) Applicant: Vakava Technologies Ltd Oy, Espoo (FI)

(72) Inventors: Arto Pitsinki, Espoo (FI); Mikko Ranta, Espoo (FI)

(73) Assignee: VAKAVA TECHNOLOGIES LTD OY, Espoo (FI)

( * ) Notice: Subject to any disclaimer, the term of this patent is extended or adjusted under 35 U.S.C. 154(b) by 166 days.

(21) Appl. No.: 15/742,907

(22) PCT Filed: Jul. 7, 2016

(86) PCT No.: PCT/FI2016/050503
§ 371 (c)(1),
(2) Date: Jan. 9, 2018

(87) PCT Pub. No.: WO2017/009527
PCT Pub. Date: Jan. 19, 2017

(65) Prior Publication Data

US 2018/0216864 A1 Aug. 2, 2018

(30) Foreign Application Priority Data

Jul. 10, 2015 (FI) ..... 20155552

(51) Int. Cl.
*F25D 3/12* (2006.01)
*F25D 29/00* (2006.01)

(52) U.S. Cl.
CPC ..... *F25D 3/125* (2013.01); *F25D 29/001* (2013.01); *F25D 2303/0844* (2013.01); *F25D 2323/061* (2013.01); *F25D 2331/804* (2013.01)

(58) Field of Classification Search
CPC ..... F25D 3/125; F25D 29/001; F25D 2303/0844; F25D 2323/061; F25D 2331/804
See application file for complete search history.

(56) References Cited

U.S. PATENT DOCUMENTS 3,163,022 A * 12/1964 Hottenroth ..... F25D 3/125 62/168
4,096,707 A 6/1978 Taylor
(Continued)

FOREIGN PATENT DOCUMENTS

CN 1685184 A 10/2005
GB 326196 A 3/1930
(Continued)

OTHER PUBLICATIONS

The State Intellectual Prpoery Office of the People's Republic of China, English translation of Search report of parallel Chinese application No. 201680040719.5, dated Sep. 27, 2019, 2 pages.

*Primary Examiner* — Melvin Jones
(74) *Attorney, Agent, or Firm* — Berggren LLP

(57) ABSTRACT

There is provided improved utilisation of the cooling capacity in dry ice. An apparatus comprises at least one sealed container for dry ice enclosed within another sealed container, wherein the at least one sealed container for dry ice is operatively connected to a storage container for cooling the storage container to a target temperature or to a target temperature range by sublimed dry ice from the at least one sealed container for dry ice, and the at least one sealed container for dry ice is operatively connected to said another sealed container for conducting sublimed dry ice from the at least one sealed container for dry ice to said another sealed container, when the target temperature of the storage container is met.

21 Claims, 4 Drawing Sheets

(56) References Cited

U.S. PATENT DOCUMENTS

| | | | | | |
|---|---|---|---|---|---|
| 4,457,142 | A * | 7/1984 | Bucher | F25D 3/125 | 62/388 |
| 4,576,010 | A * | 3/1986 | Windecker | F25D 29/001 | 62/161 |
| 4,593,536 | A * | 6/1986 | Fink | B60P 3/20 | 62/239 |
| 5,074,126 | A | 12/1991 | Mahieu | | |
| 5,363,670 | A * | 11/1994 | Bartilucci | F25D 3/12 | 62/166 |
| 5,638,688 | A | 6/1997 | Reznikov et al. | | |
| 5,660,057 | A * | 8/1997 | Tyree, Jr. | B61D 27/0081 | 62/239 |
| 5,715,685 | A * | 2/1998 | Takasugi | F25D 3/105 | 62/52.1 |
| 2003/0041601 | A1 * | 3/2003 | Graham | F25D 3/105 | 62/52.1 |
| 2015/0204598 | A1 * | 7/2015 | Affleck | B65B 3/003 | 700/228 |

FOREIGN PATENT DOCUMENTS

| | | | |
|---|---|---|---|
| JP | H03501877 | A | 4/1991 |
| JP | 2000193354 | A | 7/2000 |

* cited by examiner

APPARATUS COMPRISING SEALED CONTAINER FOR DRY ICE AND TRANSPORT CONTAINER STRUCTURE

FIELD

The present invention relates to cooling of products by dry ice.

BACKGROUND

U.S. Pat. No. 5,363,670 discloses a self-contained cooler/freezer apparatus for carrying items in a frozen or refrigerated environment. The apparatus comprises an insulated container which is divided into two portions. The first portion is utilized for item storage and the second portion houses a pressurized coolant compartment for storing a dry ice. The pressurized coolant compartment comprises removable insulation panel. In essence, the pressurized coolant compartment is a controllable heat sink. Within a short period of time, the dry ice starts to sublimate, thereby forming cold gaseous carbon dioxide at a high pressure. The cold gaseous carbon dioxide is circulated throughout the insulated container via a solenoid actuated gas feed valve, thereby further cooling the first portion of the insulated container. A thermostatic controller activates the gas feed valve based upon temperature readings from thermocouples located within the first portion of the insulated container. A pressure relief valve is positioned within the insulated container to prevent the pressure within the insulated container from building beyond a maximum value. The sublimation of the dry ice causes pressure that is relieved outside the apparatus.

When cold gaseous carbon dioxide formed from sublimation of the dry ice is conducted out of the apparatus, the carbon dioxide cannot be used for cooling anymore.

BRIEF DESCRIPTION OF SOME EMBODIMENTS

An object of the present invention is to provide an apparatus that alleviates at least part of the disadvantages identified above. The object of the present invention is achieved by an apparatus characterized by what is stated in the independent claim. The dependent claims describe embodiments of the present invention.

Some embodiments provide improved utilisation of the cooling capacity in dry ice. The sublimed dry ice is not directly relieved outside of the apparatus, but the sublimed dry ice is used to cool down solid dry ice. In this way the sublimation rate of the dry ice can be controlled.

Some embodiments provide a transport container structure capable of utilizing dry ice for adjusting the temperature within the transport container.

In some embodiments the sublimed dry ice may be released outside after being utilised both in cooling a storage container and in increasing the sublimation rate of the dry ice.

BRIEF DESCRIPTION OF THE DRAWINGS

Embodiments are described with reference to the attached drawings in which.

DETAILED DESCRIPTION

Various embodiments herein describe an apparatus utilising dry ice as coolant. Dry ice may is the solid form of carbon dioxide. Dry ice sublimes at −78.5° C. at Earth atmospheric pressures. In sublimation of the solid dry ice, the dry ice is transitioned directly from a solid phase to a gas phase without passing through an intermediate liquid phase. In the following sublimed dry ice refers to dry ice in the gas phase. The extreme cold of the solid dry ice makes the solid dry ice dangerous to handle without protection due to burns caused by freezing (frostbite). While generally not very toxic, the outgassing from it can cause hypercapnia due to buildup in confined locations.

Figure 1:
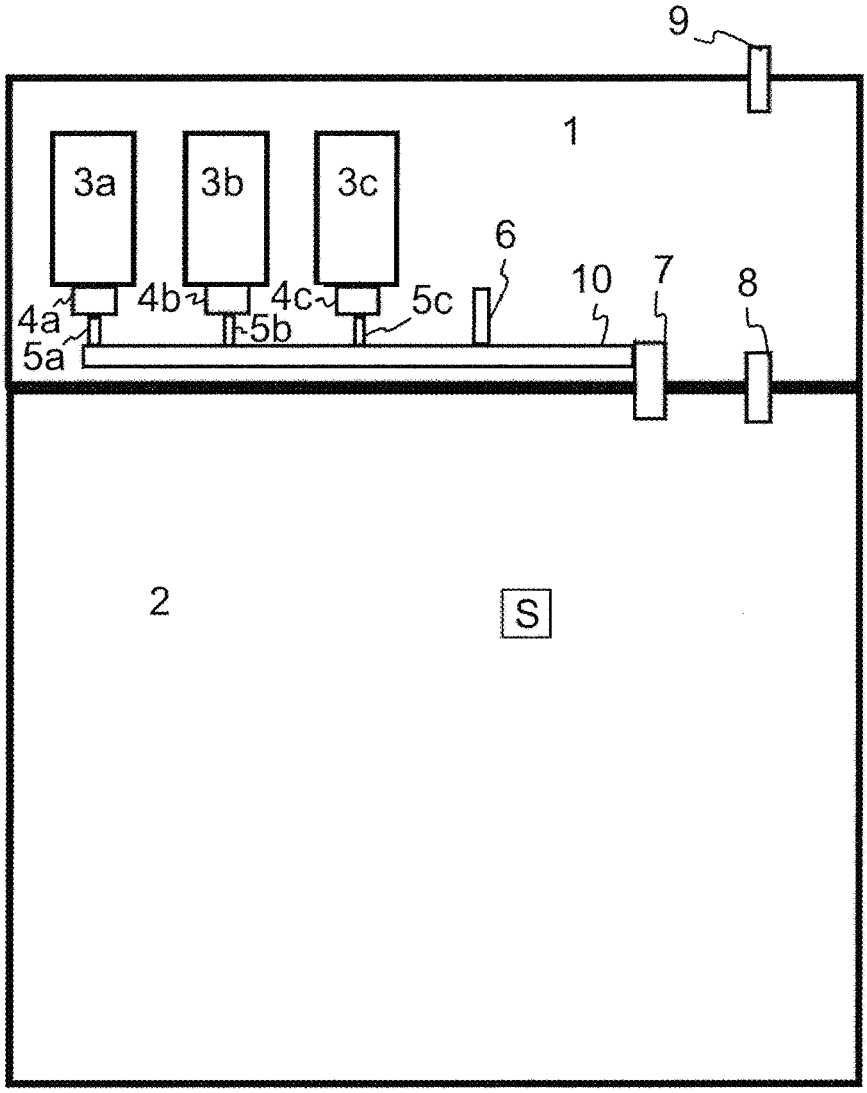
FIG. 1 illustrates an apparatus according to an embodiment.

FIG. 1 illustrates an apparatus according to embodiment. The apparatus may comprise at least one sealed container 3*a*, 3*b*, 3*c* for dry ice. The sealed container may be referred as a dry ice container. The dry ice container may be enclosed within another sealed 1 container that may be referred to as an enclosure. The dry ice container may be operatively connected to a storage container 2 for cooling the storage container to a target temperature or to a target temperature range by sublimed dry ice from the first container. The dry ice container may be operatively connected to the enclosure for conducting sublimed dry ice from the dry ice container to the enclosure when the target temperature or temperature range of the storage container is met.

In this way the dry ice may be first used as coolant for cooling the storage container 2 and after the target temperature or temperature range has been reached within the storage container, the dry ice may be used for cooling the dry ice container. Since the coolant fed to the enclosure is sublimed dry ice that has not been used for cooling the storage container, the coolant has a high cooling capacity and the coolant may efficiently cool down the container for dry ice and thereby the dry ice within the container. The cooling capacity of the coolant may be determined as the capability, for example measured in Watts, of removing heat. Cooling the container for dry ice provides that the sublimation rate of the dry ice may be controlled, e.g. reduced. The sublimation rate may be defined by weight of dry ice sublimed per a time unit, e.g. kg/h.

The sublimation of the dry ice may be caused by warming-up of the dry ice. The warming-up of the dry ice may be caused by the prevailing temperature in the environment of the apparatus being higher than the sublimation temperature of dry ice.

The target temperature or temperature range of the storage container may be defined by the type of items stored in the storage container. The items may be organic items that require storing in a specific temperature or temperature range such that their properties may be maintained during the time the items are stored the storage container. Examples of organic items comprise human organs, animal organs, living matter, bacteria growth and viral growth. It should be appreciated that the target temperature or temperature range may be represented by a pressure value or a pressure range within the storage container.

The dry ice container and the enclosure may be sealed such that the containers may hold a pressure caused by gas generated from sublimation of the dry ice. The dry ice container and the enclosure may be connected together such that they form a sealed entity for efficient transfer of sublimed dry ice between the storage container, the enclosure and the dry ice container within the enclosure.

In an embodiment, the apparatus may comprise a plurality of dry ice containers 3*a*, 3*b*, 3*c* that are operatively connected to the storage container. The number of dry ice containers may be determined according to the needed cooling capacity. The needed cooling capacity may be determined on the basis of a plurality of factors comprising for example outside temperature of the apparatus, target temperature or temperature range of the storage container and volume of the storage container.

In an embodiment, the enclosure 1 may have a door for removal of one or more dry ice containers. Since the storage container is sealed, the dry ice containers may be removed through the door without the sublimed dry ice being released from the storage container.

In an embodiment the storage container 2 and the enclosure 1 may be connected such that, when a pressure within the storage container exceeds a threshold for pressure within the storage container, sublimed dry ice that has a reduced cooling capacity from cooling the storage container may be relieved from the storage container to the enclosure. In this way sublimed dry ice from the storage container may be used to heat up the sealed container holding the dry ice and increase the sublimation rate of the dry ice. The sublimed dry ice may be relieved through a relief valve 8 that connects the storage container and the enclosure.

In an embodiment the enclosure 1 may have a relief valve 9 that is caused to relieve sublimed dry ice from the enclosure and out of the apparatus, when a threshold for pressure within the enclosure is exceeded. The relief valve may provide that accumulation of sublimed dry ice within the apparatus may be prevented.

Preferably the relief valves 8, 9 may be caused to relief the sublimed dry ice before the pressure reaches the triple-point of dry ice. In this way the pressure within the apparatus may be kept sufficiently low, i.e. below the triple point, to avoid the sublimed dry ice from transforming into liquid. The relief valves maybe caused to relieve sublimed dry ice on the basis of the pressure difference of the connected spaces. The relief valves also provide that the relieved sublimed dry ice flows only in one direction, thereby preventing relieved sublimed dry ice from returning.

In an embodiment the apparatus may comprise a fluid line 10 for connecting the dry ice container 3 and the storage container 2, and a temperature controllable valve 7 arranged get to regulate the flow of sublimed dry ice to the storage container from the fluid line on the basis of the temperature within the storage container. The temperature controllable valve may enable and disable flow of the sublimed dry ice to the storage container such that the storage container may be maintained at the target temperature or the target temperature range.

The flow of the dry ice may be enabled by opening the valve, and the flow of the dry ice may be disabled by closing the valve. Accordingly, when the temperature controllable valve is open the sublimed dry ice may flow to the storage container from the fluid line. When the temperature controllable valve is closed, the sublimed dry ice cannot enter the storage container.

The temperature controllable valve may operate as a thermostat that may capable of sensing the temperature within the storage container by a sensor 'S'. The temperature controlled valve may be connected to the sensor 'S' for obtaining temperature measurements from inside of the storage container and for enabling or disabling the flow of the sublimed dry ice into the storage container on the basis of the temperature measurements from the sensor. When the temperature within the storage container is above the target temperature, the flow of sublimed dry ice into the storage container may be enabled and when the temperature within the storage container is at the target temperature or lower than the target temperature the flow of sublimed dry ice in to the storage container may be disabled.

In an embodiment a fluid line 10 may be connected to the enclosure by a valve 6 that may be controlled on the basis of at least one of a pressure within the fluid line and control of the flow of sublimed dry ice by a temperature controllable valve 7 arranged to regulate the flow of sublimed dry ice to the storage container. When the pressure within the fluid line exceeds a threshold for pressure, the valve 6 may be controlled to open and allow the sublimed dry ice to flow to the enclosure 1. The threshold pressure may be defined on the basis of the amount of dry ice and with respect to a cooling need of the storage container 2.

The cooling need may be determined on the basis of whether the storage container is at the target temperature or target temperature range. The cooling need causes the control of the temperature controlled valve. When the storage container is not at the target temperature or the target temperature range, the temperature controllable valve 7 arranged to regulate the flow of sublimed dry ice to the storage container from the fluid line may be opened, and when the storage container is at the target temperature or the target temperature range, the storage container does not need to be cooled and the temperature controllable valve may be closed. Accordingly, the valve 6 may be arranged to open when the temperature controllable valve is closed and the threshold for pressure within the fluid line is exceeded. In this way the sublimed dry ice is may be conducted to the enclosure for cooling the dry is container without further cooling the storage container.

On the other hand, the valve 6 may be closed if the threshold for pressure within the fluid line is not exceeded and/or when the temperature controllable valve is open 7. Accordingly, the fluid line may hold sublimed dry ice to be fed to the storage container for cooling the storage container, and on the other hand if there is no need for cooling the storage container the sublimed dry ice may be conducted to the enclosure for cooling down the dry ice container such that the sublimation rate of the dry ice may be reduced.

The connections between the dry ice container, the storage container and the enclosure may be provided by means for conducting sublimed dry ice. Examples of such means comprise a fluid line 10, a fluid passage and a fluid duct and a fluid hose. The means for conducting sublimed dry ice may be controllable to provide operative connections between the dry ice container, the storage container and the enclosure. The operative connections may allow enabling and disabling the flow of sublimed dry ice between the dry ice container and the storage container, and between the dry ice container and the enclosure. The control of the conduction of the dry ice may be provided by one or more valves 5*a*, 5*b*, 5*c*, 6, 7, 8 that may be opened for enabling flow of sublimed dry ice, and closed for disabling flow of sublimed dry ice. The opening and closing of the valves may be controlled by pressure of the sublimed dry ice and/or temperature of the storage container.

In an example of controlling a valve by pressure of the sublimed dry ice, the valve may be manually set a threshold pressure. When the threshold pressure is met, the valve may be opened and if the threshold pressure is not met, the valve may be closed. The threshold pressure may be set such that the storage container may be maintained in the target temperature or temperature range. It should be appreciated that also magnetic valves may be used. The magnetic valve may be caused to open and close on the basis of the current temperature within the storage container and a result of the comparison of the current temperature with the target temperature or with the target temperature range. The current temperature may be measured by sensor 'S'. On the other hand, and particularly, when the sublimed dry ice is not conducted to the storage container the dry ice may be conducted to the enclosure for cooling the dry ice container. However, once the storage container needs cooling, the cooling of the dry ice container is topped and the sublimed dry ice is conducted to the storage container. The cooling need of the storage container may be determined on the basis of the target temperature or target temperature range not being met in the storage container.

In an embodiment one or more dry ice containers may be connected to the fluid line 10 by a quick release coupling 4*a*, 4*b*, 4*c* and a back-pressure valve 5*a*, 5*b*, 5*c*. The back-pressure valve 5*a*, 5*b*, 5*c* provides that sublimed dry ice discharged from the dry ice container does not return to the dry ice container and the sublimed dry ice may be kept within the fluid line, when the dry ice container is released e.g. when being replaced. Accordingly, the back-pressure valve and the quick-release coupling may form a part of the fluid line 10. In this way the storage container may be cooled down by the sublimed dry ice preserved within the fluid line after the dry ice container is disconnected from the fluid line.

In an embodiment, components of the apparatus that generate heat may be installed within the enclosure 1. In this way the heat generated from the components may be used to increase the sublimation rate of the dry ice. In one example, one or more parts of the temperature control system of FIG. 2 may be installed to the enclosure. The temperature control system may comprise magnetic valves that may be opened by electric current that cause generation of heat in the valve. Heat may be generated, for example, when the temperature controllable 7 valve is a magnetic valve and electric current is fed to the valve for opening the valve. Thanks to the location of the temperature controllable valve within the enclosure, the heat generated by the temperature controllable valve may be used to increase the sublimation rate of the dry ice. In this way production of sublimed dry ice may be increased for further cooling of the storage container. Then, when the target temperature of the storage container has been reached the temperature controllable valve may be closed by cutting-off the current. In this position, the temperature controllable valve does not generate heat and the sublimation rate of the dry ice may be reduced. Further reduction of the sublimation rate may be achieved by conducting the sublimed dry ice directly to the enclosure from the fluid line via valve 6.

Figure 2:
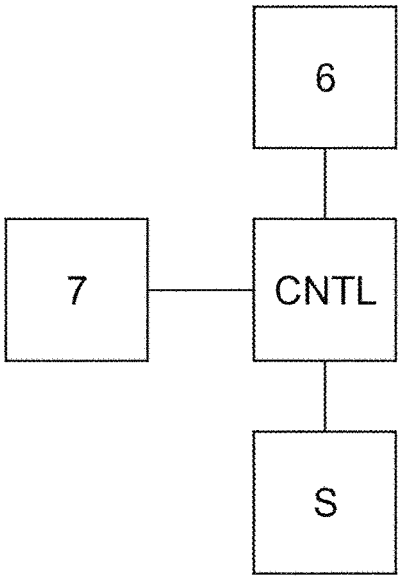
FIG. 2 illustrates a temperature control system according to an embodiment.

FIG. 2 illustrates a temperature control system according to an embodiment. The temperature control system may be used to control flow of sublimed dry ice into the storage container 2 or into the enclosure 1 or both the storage container and the enclosure in the embodiments described herein. The temperature control system is now described with reference to same or corresponding items in FIG. 1. The temperature control system may comprise one or more temperature controllable valves 6, 7, a temperature sensor 'S' and a controller 'CNTL' connected to the sensor and valves such that the valves may be opened and closed on the basis of the measurements of the sensor. The sensor 'S' may be arranged within the storage container to obtain temperature measurements for controlling the valve. The temperature controlled valve may operate as a thermostat that may sense the temperature within the storage container by the sensor and enables and disables flow of the sublimed dry ice to the storage container such that the storage container may be maintained at the target temperature or the target temperature range.

The units of the temperature control system in FIG. 2 may be implemented as single units or the units may be combined into larger units. In one example, the temperature controllable valve 7 may include the controller 'CNTL'. The connection between the units in FIG. 2 may be electrical connections by electrical wires for example. Accordingly, the valves in FIG. 2 may be magnetic valves controlled by electric current from the controller.

The controller may be a processor, microcontroller or a Field Programmable Gate Array (FPGA) for example. The controller may have a memory for storing a computer program for execution by the controller. The controller and the memory may form processing means for carrying out an embodiment described herein. The processing means may be a computer or a part of computer.

In an embodiment there is provided a computer program comprising computer program code for execution on a computer to cause one or more functionalities according to an embodiment, when said product is run on a computer. The computer program may be embodied on a computer-readable storage medium.

In an embodiment there is provided a computer program product for a computer, comprising a computer program according to an embodiment.

An embodiment concerns a computer program embodied on a computer-readable storage medium, the computer program comprising program to execute a process comprising a method according an embodiment.

When the temperature within the storage container is at the target temperature or the temperature range, the temperature controllable valve 7 may be closed such that sublimed dry ice cannot flow to the storage container. When the temperature within the storage container is higher than the target temperature or temperature range the temperature controllable valve 7 may be opened such that sublimed dry ice may flow to the storage container for cooling the storage container. It should be appreciated that instead or additionally to using a temperature sensor, a pressure sensor may be used, whereby the pressure measured by the pressure sensor may be used for controlling the valve in a similar manner as the measured temperature.

Figure 3:
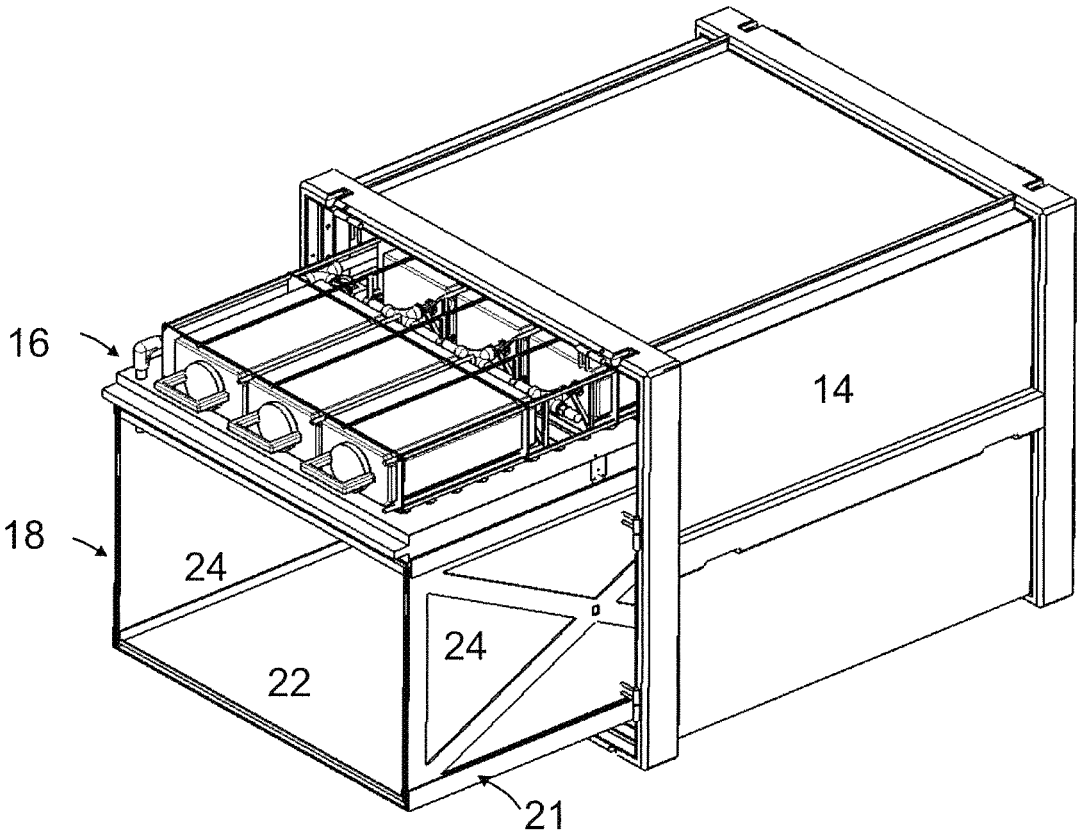
FIG. 3 illustrates an inner wall structure for a transport container according to an embodiment.
Figure 4:
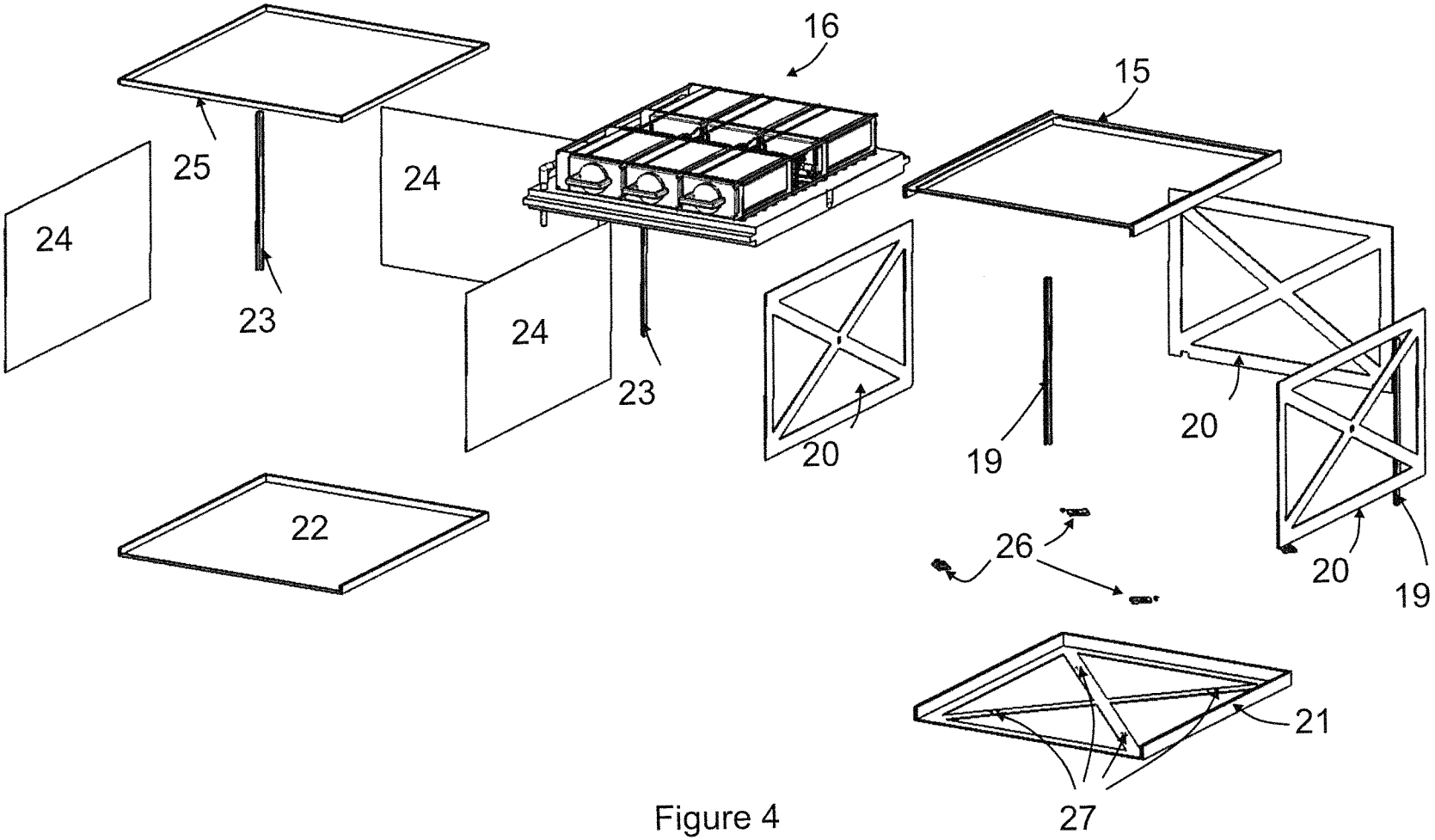
FIG. 4 is an exploded view of inner wall structure according to an embodiment.

Inner wall structures according to embodiments are now explained in the following with reference to FIG. 1 and FIG. 3 that illustrates an inner wall structure for a transport container 14 according to an embodiment and with reference to FIG. 4 that is an exploded view of inner wall structure according to an embodiment. In FIG. 3, the inner wall structure is illustrated partially within the transport container. However, it should be appreciated that the dimensions of the inner wall structure are smaller than the dimensions of the transport container to allow the inner wall structure to be installed completely within the transport container. Accordingly, the inner wall structure may be capable of accommodating substantially the whole volume of the transport container when the inner wall structure is installed within the transport container. When the inner wall structure is installed and enclosed within the transport container, the transport container is capable of utilizing dry ice for adjusting the temperature within the transport container. When the inner wall structure of the transport container is enclosed within the transport container, the transport container substantially covers the inner wall structure from all sides such that the inner wall structure is protected against external contact, for example impacts.

In an embodiment the inner wall structure may comprise one or more parts of an apparatus described above. Preferably the parts comprise one or more dry ice containers 3*a*, 3*b*, 3*c* and a storage container 2. Accordingly, the inner wall structure may comprise an apparatus described in the above embodiments that is adapted to accommodate substantially the whole volume of the transport container when installed within the transport container.

The inner wall structure may comprise a first portion 16 comprising at least one sealed container 3*a*, 3*b*, 3*c* for dry ice, and a second portion 18 comprising a storage container 2. The at least one sealed container 3*a*, 3*b*, 3*c* for dry ice may be operatively connected to a storage container 2 for cooling the storage container to a target temperature or to a target temperature range by sublimed dry ice from the at least one sealed container for dry ice. In this way the transport container enclosing the inner wall structure may be capable of utilizing dry ice for adjusting the temperature within the transport container.

In an example, the second portion 18 comprising a storage container 2 may comprise a support frame 15, 19, 20, 21 and cover parts 22, 23, 24, 25 capable of being installed on the support frame. The cover parts may provide thermal insulation such that the temperature within the storage container may be protected against the conditions prevailing outside the inner wall structure of the transport container and the conditions prevailing outside the transport container.

The support frame may be configured from side frames 20 for each side wall of the inner wall structure, a floor frame 21 and a top frame 15. The side frame, floor frame and the top frame may be adapted such that they may be attached together. The support frame may have frame adapters 19 for attaching side frames to each other, and side frames to floor frame and top frame. When attached together the support frame may form a frame for the storage container.

The cover parts may comprise a floor 22, a top cover 25 and side covers 24 and cover adapters 23 for attaching side covers to each other, and side frames to floor and top cover. The cover parts and the dry ice containers may be installed on the support frame to form the portions of the inner wall structure. In this way items stored on the floor within the storage container may be supported by the support frame and the dry ice containers may be supported above the storage container for utilizing dry ice for adjusting the temperature within the transport container. Thanks to the arrangement of cover parts and the support frame, items place within the storage container may be measured by weight sensors positioned under the floor as will be described below in more detail.

The inner wall structure according to an embodiment may further comprise at least one sealed container 3*a*, 3*b*, 3*c* for dry ice that may be enclosed within another sealed container 1, and the at least one sealed container 3*a*, 3*b*, 3*c* for dry ice may be operatively connected to said another sealed container 1 for conducting sublimed dry ice from the at least one sealed container 3*a*, 3*b*, 3*c* for dry ice to said another sealed container 1, when the target temperature of the storage container is met. Accordingly, the dry ice may be enclosed within an enclosure.

In an embodiment the inner wall structure may have a support frame 21 on which a floor 22 of the storage container is resiliently installed and one or more weight sensors 26 may be positioned on the frame under the floor of the storage container for operating with the floor of the storage container for measuring weight of the contents of the storage container. The frame may comprise installation positions 27, e.g. holes, for installing the weight sensors to the frame. The resilient installation of the floor may transfer the weight of the items placed on the floor of the storage container such that the items and/or their weight may be detected by the weight sensors. The resilient installation may be provided by the material of the structure and/or material of the floor. The items positioned on the floor of the storage container may cause activation of the sensors, whereby presence of items may be detected within the storage container. The weight sensors may be capable of measuring weight, whereby each item placed within the storage container or removed from the storage container may cause a new measurement value. The measurement values may be applied in monitoring one or more of the following: a number of items within the storage container, total weight of the items within the storage container and weight of single items within the storage container. In one example the support frame may have the form of a diagonal cross, like the shape of the letter X in Roman type. The arms for the diagonal cross extend diagonally over the cover part supported by the support frame. The weight sensor may be positioned away to one or more positions of the diagonal cross said positions comprising: arms of the cross, to middle of the cross. Preferably a weight sensor positioned in the arm of the cross away from the middle of the cross and the end of the arm. Possible locations for the weight sensor in the arms may be in the middle of the arm and towards the end of the arm away from the middle of the arm.

In an embodiment an inner wall structure according to an embodiment may be collapsible. In this way the volume needed by the inner wall structure, when the inner wall structure is collapsed may be small, whereby efficiency of storage and transportation of collapsed the inner wall structures may be provided.

In an example, the support frame may have the form of a diagonal cross, like the shape of the letter X in Roman type. The arms for the diagonal cross extend diagonally over the cover part supported by the support frame. The arms of the diagonal cross may be formed of parts that are interconnected movable for collapsing the sides of the inner wall structure. The support frames may have a locking mechanism for locking the arms of the diagonal cross and avoiding collapse of the support members.

In an embodiment a transport container may comprise the inner wall structure. The inner wall structure may be slidably interchangeable from the transport container. In this way the inner wall structure may be installed within the transport container and removed from the transport container by sliding movement. Sliding of the inner wall structure may be provided, when the inner wall structure has one or more skids that allow easy sliding in and/or out of the transport container. The material of the support frame and the transport container may be adapted to support the sliding. Accordingly, the surfaces of the support frame that is acting against the transport container may be adapted to support sliding between the transport container and the support frame.

It should be appreciated that the inner wall structure may not need separate skids, but the support frame of the inner wall structure may serve the purpose of the skids. Accordingly, particularly a portion 21 of the support frame for supporting the floor 22 may be used as skids.

In an embodiment the transport container may be a cargo container or a transport cabinet. A cargo container may be a standard intermodal freight container conventionally used in cargo ships for example. A transport cabinet may be a cabinet movable manually by personnel by pushing and pulling. Such transport cabinets are conventional for example in grocery shops, where temperature sensitive goods are received in the transport cabinets from trucks at loading ramp and thereafter moved between inside to the grocery shop for storage or directly to the sales area.

The transport container may be made of material capable of providing sufficient protection to the inner wall structure against external contact during transportation. The type of material and strength of the material may be adapted on the basis of the kind of transportation the container is utilized and the level of protection needed. For example when the transport container is utilized in sea transportation the transport container may be made of material conventionally used in standard intermodal freight containers. Accordingly it should be appreciated that the material may be for example plastic, composite, steel or stainless steel.

Figure 5:
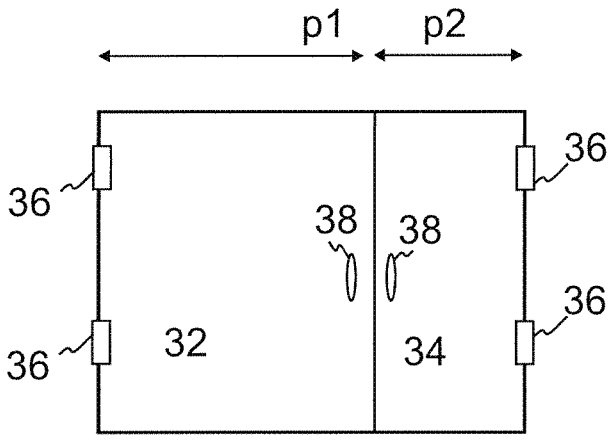
FIG. 5 illustrates an example of an apparatus having doors according to an embodiment.

FIG. 5 illustrates an example of an apparatus having doors according to an embodiment. The apparatus may have one or more doors. The doors may be opened and closed. In an open position, the doors may allow removal of contents within the apparatus and placing contents within the apparatus. The contents may be at least one or more dry ice containers, storage containers and items for storing in storage containers. Accordingly, the door may provide access to one or more dry ice containers, the storage container and items for storing within the storage container in the apparatus. In one example the doors are arranged in the enclosure for removal and installing one or more dry ice containers. In another example the doors may be arranged in a transport container for removal and installing an inner wall structure. When the inner wall structure is installed within the transport container the doors provide accessing the inner wall structure within the transport container for example for the purpose of removing items from the storage container, storing items to the storage container and replacing dry ice containers. In a closed position, the door or cover may allow enclosing the contents within the apparatus. Accordingly doors provided on the transport container allow enclosing the inner wall structure within the transport container.

The door or cover may have more than one part 32, 34, which both may be opened and closed. The door parts may form double doors. Each of the door parts or cover parts may cover only a portion 'p1', 'p2' of the side of the transport container. In this way items may be removed and inserted into the storage container without opening the transport container all the way, whereby flow of outside air to the storage container may be hindered at least partially. The door parts may be substantially equally large such that they cover a substantially similar portion of the transport container. Preferably the door parts are dimensioned such that one 32 of the parts is larger than the other 34. In this way items within the storage portion may be accessed opening the smaller portion and flow of outside air to the storage container may be hindered more than if the parts were substantially equally large.

The door and door parts may be connected to the transport container by hinges 36 such that they are movable to the open position and closed position.

It should be appreciated that instead of doors a single cover or cover parts may be adapted with the transport container such that they may be removed from the transport container and installed to transport container for closing the transport container similar to the door and door parts. The cover and cover parts may be attached to the transport container by latches.

In an embodiment, the doors may have gripping portions 38, for example handles, for facilitating operating the doors to the open or closed position. The gripping portions may be arranged in a recess such that the surface of the transport container may be substantially flush.

Figure 6:
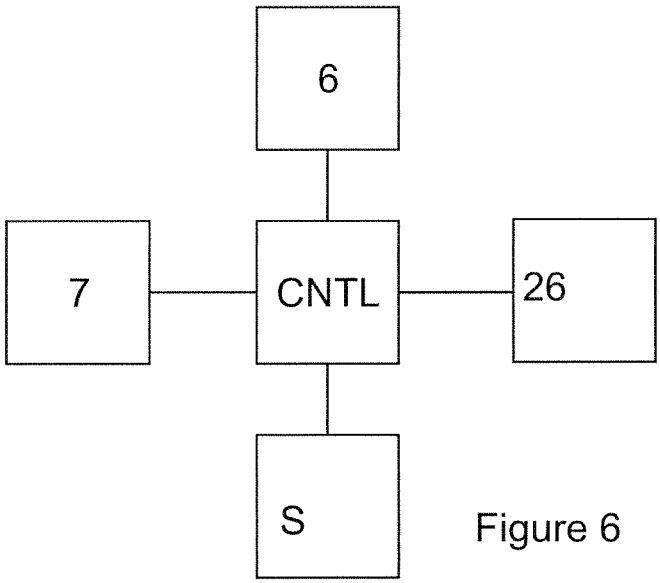
FIG. 6 illustrates a temperature control system according to an embodiment.

FIG. 6 illustrates a temperature control system according to an embodiment. With reference to FIGS. 1, 2, 4 and 6, the temperature control system may be capable of measuring weight of the contents of the storage container for controlling temperature by controlling flow of sublimed dry ice into the storage container 2 or into the enclosure 1 or both the storage container and the enclosure in the embodiments described herein.

The controller 'CNTL' may be connected to a weight sensor 26 such that the valves 6, 7 may be opened and closed on the basis of the measurements of the temperature sensor and the weight sensor. The weight sensor 26 may be positioned on the support frame 21 under the floor 22 of the storage container for operating with the floor of the storage container for measuring weight of the contents of the storage container.

The units of the temperature control system in FIG. 6 may be implemented as single units or the units may be combined into larger units. The connections between the units in FIG. 6 may be electrical connections by electrical wires for example.

In various embodiments described above, sublimed dry ice from the dry ice container may be conducted to the storage container for cooling the storage container to a target temperature or to a target temperature range. The dry ice may flow out of the storage container provided by the pressure within the dry ice container being higher than the pressure within the storage container, the pressure within the enclosure around the dry ice container and/or the pressure within the fluid line. Accordingly, the apparatus according to various embodiments described herein may operate as powered by the sublimation of the dry ice and without further power sources. However, some embodiments may be implemented using magnetic valves, whereby accurate control of the temperature in the storage container and control of the sublimation rate may be obtained.

It will be obvious to a person skilled in the art that, as the technology advances, the inventive concept can be implemented in various ways. The invention and its embodiments are not limited to the examples described above but may vary within the scope of the claims.

The invention claimed is:

1. An apparatus comprising at least one sealed container for dry ice, said at least one sealed container for dry ice being enclosed within another sealed container, wherein the at least one sealed container for dry ice is operatively connected to a storage container for cooling the storage container to a target temperature or to a target temperature range by conducting sublimed dry ice from the at least one sealed container for dry ice to the storage container, and the at least one sealed container for dry ice is operatively connected to said another sealed container for conducting sublimed dry ice from the at least one sealed container for dry ice to said another sealed container, when the target temperature of the storage container is met, wherein the at least one sealed container for dry ice is connected to said another sealed container so that sublimed dry ice can be conducted directly to said another sealed container without using the sublimed dry ice for cooling the storage container.

2. The apparatus according to claim 1, wherein the storage container and said another sealed container are connected such that, when a pressure within the storage container exceeds a threshold for pressure within the storage container, sublimed dry ice from the storage container is relieved to said another sealed container.

3. The apparatus according to claim 1, wherein said another sealed container has a relief valve that is caused to relieve sublimed dry ice from said another sealed container and out of the apparatus, when a threshold for pressure within said another sealed container is exceeded.

4. The apparatus according to claim 1, wherein the apparatus further comprises a fluid line for connecting the said at least one sealed container for dry ice and the storage container, and a temperature controllable valve arranged to regulate the flow of sublimed dry ice to the storage container from the fluid line on the basis of the temperature within the storage container.

5. The apparatus according to claim 1, wherein the apparatus further comprises a fluid line connected to said another sealed container by a valve that is controlled on the basis of at least one of a pressure within the fluid line and control of the flow of sublimed dry ice by a temperature controllable valve arranged to regulate the flow of sublimed dry ice to the storage container.

6. The apparatus according to claim 1, wherein the storage container and said another sealed container are connected by a relief valve.

7. The apparatus according to claim 1, wherein the apparatus further comprises a fluid line and at least one sealed container for dry ice is connected to the fluid line by a quick release coupling and a back-pressure valve.

8. The apparatus according to claim 1, wherein the apparatus further comprises a plurality of sealed containers for dry ice that are operatively connected to the storage container.

9. The apparatus according to claim 1, wherein said another sealed container has a door for removal of one or more sealed containers for dry ice.

10. The apparatus according to claim 1, wherein components generating heat are installed within said another sealed container.

11. An inner wall structure for a transport container, wherein the inner wall structure is capable of accommodating substantially whole volume of the transport container and the inner container structure comprises:

a first portion comprising at least one sealed for dry ice, and a second portion comprising a storage container;

wherein the at least one sealed container for dry ice is operatively connected to a storage container for cooling the storage container to a target temperature or to a target temperature range by conducting sublimed dry ice from the at least one sealed container for dry ice to the storage container, and said at least one sealed container for dry ice is enclosed within another sealed container, and the at least one sealed container for dry ice is operatively connected to said another sealed container for conducting sublimed dry ice from the at least one sealed container for dry ice to said another sealed container, when the target temperature of the storage container is met, the at least one sealed container for dry ice being connected to said another sealed container so that sublimed dry ice can be conducted directly to said another sealed container without using the sublimed dry ice for cooling the storage container.

12. The inner wall structure for a transport container according to claim 11, wherein the inner wall structure has a support frame on which a floor of the storage container is resiliently installed and one or more weight sensors are positioned on the frame under the floor of the storage container for operating with the floor of the storage container for measuring weight of the contents of the storage container.

13. The inner wall structure for a transport container according to claim 12, wherein the frame has a form of a diagonal cross and the sensors are positioned to arms of the cross, for example towards the ends of the arms from the middle of the arms.

14. The inner wall structure for a transport container according to claim 11, wherein the inner wall structure is collapsible.

15. The inner wall structure for a transport container according to claim 11, wherein the inner wall structure is capable of measuring weight of contents of the storage container for controlling temperature by controlling flow of sublimed dry ice into the storage container or into the sealed container or both the storage container and the sealed container.

16. The inner wall structure for a transport container according to claim 11, wherein the inner wall structure for a transport container comprises at least one sealed container for dry ice, said at least one sealed container for dry ice is enclosed within another sealed container, wherein the at least one sealed container for dry ice is operatively connected to a storage container for cooling the storage container to a target temperature or to a target temperature range by sublimed dry ice from the at least one sealed container for dry ice, and the at least one sealed container for dry ice is operatively connected to said another sealed container for conducting sublimed dry ice from the at least one sealed container for dry ice to said another sealed container, when the target temperature of the storage container is met.

17. A transport container comprising an inner wall structure capable of accommodating substantially whole volume of the transport container, the inner wall structure comprising:

a first portion comprising at least one sealed container for dry ice, and a second portion comprising a storage container;

wherein the at least one sealed container for dry ice is operatively connected to a storage container for cooling the storage container to a target temperature or to a target temperature range by conducting sublimed dry ice from the at least one sealed container for dry ice to the storage container, wherein the at least one sealed container for dry ice is connected to said another sealed container so that sublimed dry ice can be conducted directly to said another sealed container without using the sublimed dry ice for cooling the storage container, and the inner wall structure has a support frame and a surface of the support frame that is acting against the transport container is adapted to support sliding between the transport container and the support frame such that the inner wall structure is slidably interchangeable from the transport container.

18. The transport container according to claim 17, wherein said at least one sealed container for dry ice is enclosed within another sealed container, and the at least one sealed container for dry ice is operatively connected to said another sealed container for conducting sublimed dry ice from the at least one sealed container for dry ice to said another sealed container, when the target temperature of the storage container is met.

19. The transport container according to claim 17, wherein the transport container is at least one of a cargo container and a transport cabinet.

20. The transport container according to claim 17, wherein the transport container has double doors, where one of the double doors is larger than the other.

21. The transport container according to claim 20, wherein the doors have gripping portions arranged in recesses.

* * * * *